US006520831B1

(12) United States Patent
Craig

(10) Patent No.: US 6,520,831 B1
(45) Date of Patent: Feb. 18, 2003

(54) MODULAR DOLL HOUSE

(76) Inventor: Sarah A. Craig, 4825 Huxley Dr., Rockford, IL (US) 61101

( * ) Notice: Subject to any disclaimer, the term of this patent is extended or adjusted under 35 U.S.C. 154(b) by 0 days.

(21) Appl. No.: 09/511,626

(22) Filed: Feb. 22, 2000

(51) Int. Cl.[7] ..... A63H 3/52
(52) U.S. Cl. ..... 446/476; 446/105; 446/479
(58) Field of Search ..... 446/85, 105, 108, 446/109, 111, 112, 113, 114, 115, 116, 118, 122, 126, 486, 487, 477, 478, 479; 52/79.1, 79.9; 403/292, 293, 294, 295, 403

(56) References Cited

U.S. PATENT DOCUMENTS

| | | | | |
|---|---|---|---|---|
| 3,577,672 | A | | 5/1971 | Nutting |
| 3,691,671 | A | | 9/1972 | Kroll |
| 3,719,001 | A | | 3/1973 | Archer |
| 3,820,299 | A | | 6/1974 | Verholt |
| 3,827,177 | A | | 8/1974 | Wengel |
| 3,906,659 | A | | 9/1975 | Walmer |
| 3,911,634 | A | | 10/1975 | Horowitz et al. |
| 3,996,693 | A | | 12/1976 | Walmer |
| 4,018,001 | A | | 4/1977 | Walmer |
| 4,021,960 | A | | 5/1977 | Walmer |
| 4,094,090 | A | | 6/1978 | Walmer |
| 4,195,437 | A | | 4/1980 | Ace |
| 4,216,608 | A | | 8/1980 | Walmer et al. |
| 4,219,960 | A | | 9/1980 | Walmer et al. |
| 4,233,778 | A | | 11/1980 | Lemelson |
| 4,257,207 | A | * | 3/1981 | Davis ..... 52/578 |
| 4,306,371 | A | | 12/1981 | Walmer et al. |
| 4,334,683 | A | * | 6/1982 | Campbell ..... 273/126 R |
| 4,723,820 | A | | 2/1988 | Kroneck |
| 5,222,902 | A | * | 6/1993 | Piersch ..... 446/121 |
| 5,281,185 | A | * | 1/1994 | Lee ..... 446/488 |
| 5,527,201 | A | * | 6/1996 | Maddock ..... 446/104 |
| 5,647,181 | A | | 7/1997 | Hunts |
| 5,681,201 | A | * | 10/1997 | Choi ..... 446/105 |
| 5,823,531 | A | * | 10/1998 | Huber ..... 273/156 |
| 5,921,405 | A | * | 7/1999 | Dumas ..... 211/40 |

* cited by examiner

*Primary Examiner*—Derris H. Banks
*Assistant Examiner*—Faye Francis
(74) *Attorney, Agent, or Firm*—Marshall, Gerstein & Borun

(57) ABSTRACT

A modular doll house has interconnectable walls, floors and roofs that are held together by a variety of connectors. The connectors of the modular doll house include tabs which slidably engage the interconnectable walls, floors and roofs and can be easily manipulated by children to assemble and disassemble the modular doll house. Specifically, the modular doll house includes a first structural member having a first surface and a first groove disposed in the first surface and a second structural member having a second surface and a second groove disposed in the second surface. Additionally, the modular doll house has a rigid connector including a first tab adapted to slidably engage the first groove and a second tab adapted to slidably engage the second groove to connect the first structural member to the second structural member.

6 Claims, 10 Drawing Sheets

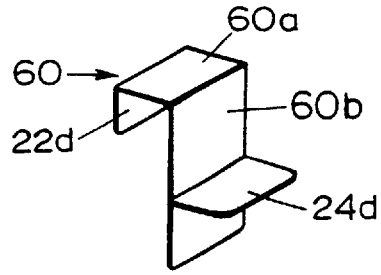
FIG. 14
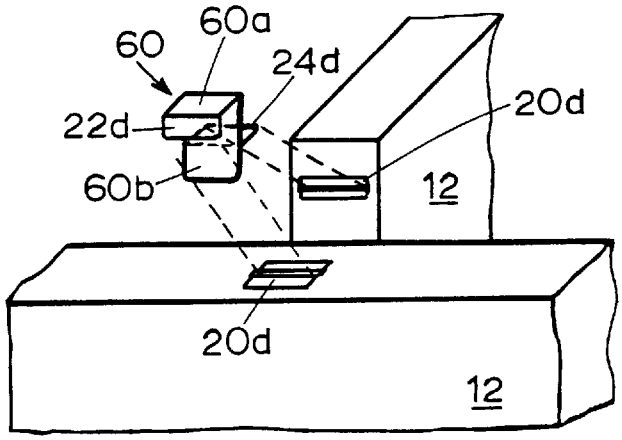
FIG. 15
FIG. 16
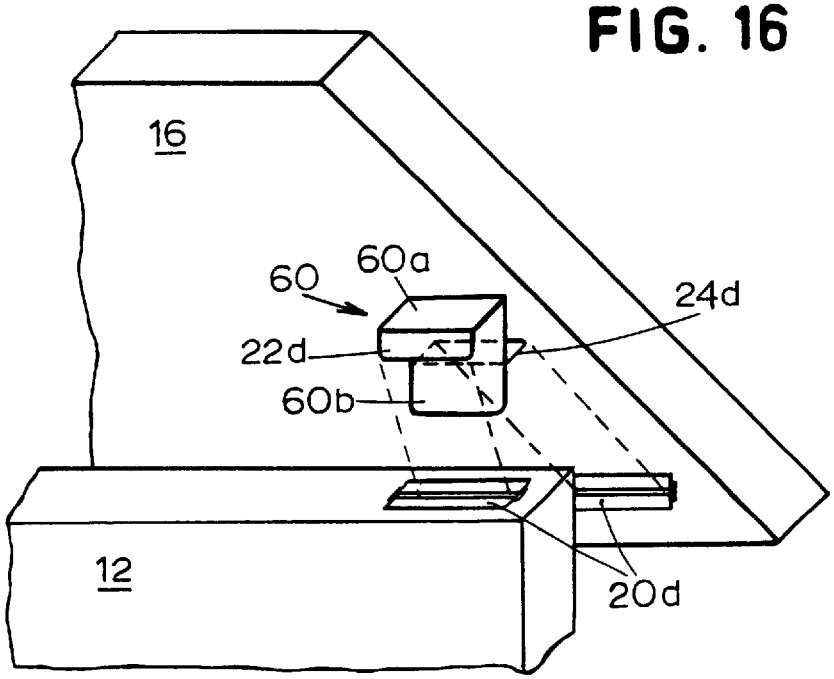

MODULAR DOLL HOUSE

TECHNICAL FIELD

The present invention relates generally to doll houses, and more particularly, to connector systems used to construct modular doll houses having interconnectable walls, floors and roofs.

BACKGROUND ART

It is common in the marketplace to find pre-assembled, permanently constructed doll houses. However, such doll houses are difficult to ship and store. Additionally, pre-assembled doll houses are often expensive and, thus, not affordable because of the manufacturer's high labor costs, which drive up the overall cost of the doll houses.

To avoid some of the problems associated with the pre-assembled, permanently constructed doll houses, manufacturers have created modular doll houses having interconnectable walls, floors and roofs that require self-assembly. Because modular doll houses can be constructed and/or taken apart, the interconnectable doll house parts have eliminated several problems associated with shipping, storage and cost. Despite such improvements, these known modular doll houses still have disadvantages. For example, most modular doll houses are made of specially designed walls, floors, roofs and other structural accessories such as fireplaces, stairs and railings which, when constructed, form a specific doll house configuration having a single, predetermined floor plan. This prefabricated configuration stifles a child's imagination and creativity. Additionally, modular doll houses are often difficult to assemble and usually require special building materials and tools. Furthermore, the walls of these modular doll houses are usually pre-cut to a certain size, which is often proportional to the size of a traditional doll house figure standing approximately 3–4 inches in height. Thus, children having these specially configured modular doll houses cannot use them with larger dolls such as Barbie® dolls, because these modular doll houses are too small.

Other modular doll houses require special connectors including pegs or pins to hold the panels together. For example, panels are held together by inserting pegs into holes in the panels. Because these special connectors include many small parts, they are difficult for young children to assemble. Moreover, the connectors used in typical modular doll houses lack strength and durability and, therefore, these modular doll houses lack the stability needed to withstand every day wear and tear.

U.S. Pat. No. 5,647,181 to Hunts discloses a method of creating a doll house using rigid sheet-like panels and panel connectors which operate to join the panels together. In operation, the connectors accept specifically configured edges of the sheet-like panels to form a locking, yet releasable snap-fit connection. The components of this system enable panels to be joined together in different arrangements to form building structures, like doll houses, with a variety of rooms, levels and floor plans.

A shortcoming of the connector system disclosed in the Hunts patent is that the panels must be cut to a predetermined dimension to create the specially configured panel edges. Such pre-cut panels hamper the creativity of the child and limit the various arrangements of panels for the doll house. Furthermore, specially configured connectors complicate manufacturing, as well as assembly.

U.S. Pat. Nos. 3,906,659 to Walmer, 4,306,371 to Walmer et al. and 4,219,960 to Walmer et al. (hereinafter "the Walmer patents") disclose collapsible doll houses that are constructed of a small number of individual panels making up the walls, floors and roofs of the doll houses. The panels are provided with grooves and slots so that all the panels slide together and support one another. Likewise, a number of different connector elements may be used to interconnect the edges of the walls, floors and roofs of these doll houses.

Although the Walmer patents provide an improved method for self assembly of doll houses, they disadvantageously restrict the doll houses to a pre-arranged, specified number of rooms that are limited in size. Also, the doll houses disclosed in these patents stifle the creativity of a child and preclude the child from playing with dolls of different sizes, especially dolls which are larger than traditional dolls.

SUMMARY OF THE INVENTION

The modular doll house according to the present invention has interconnectable structural members such as walls, floors and roofs that are held together by a variety of connectors. The connectors include tabs which slidably engage grooves cut into the structural members and, thus, join the structural members together. The walls, floors and roofs are interconnectable, in any number of configurations and thus, the modular doll house can be assembled in many different ways to stimulate a child's creativity. Additionally, the interconnectable structural members may be purchased pre-cut or may be purchased in large sheet-like panels which may be cut to a size desirable by the user. Hence, the modular doll house may be used with traditional doll house figures or non-traditional figures such as Barbie® dolls. The modular doll house can also be easily manipulated by children to thereby ease the assembly and the disassembly of the modular doll house.

In one embodiment, the modular doll house includes a first structural member having a first surface and a first groove disposed in the first surface, a second structural member having a second surface and a second groove disposed in the second surface. Additionally, the doll house has a rigid connector including a first tab adapted to slidably engage the first groove and a second tab adapted to slidably engage the second groove to connect the first structural member to the second structural member.

In some embodiments the connector has a planar strip having first and second flat sides. A first tab may extend from the first side of the planar strip and a second tab may also extend from the first side of the planar strip and may be disposed either substantially perpendicular to or substantially parallel to the first tab. In yet another embodiment, the connector includes an L-shaped strip having first and second arms. A first tab may extend substantially perpendicularly from the first arm and may be disposed substantially parallel to the second arm of the L-shaped strip. A second tab may extend substantially perpendicularly from the second arm and may be disposed substantially perpendicularly or parallel to the first arm.

In some embodiments, the connector includes an L-shaped strip having first and second arms, a joint at the connection of the first and second arms, a planar strip and a third tab. Here, a first tab extends substantially perpendicularly from the first arm and is disposed substantially parallel to the second arm of the L-shaped strip. A second tab may extend substantially perpendicularly from the second arm and is disposed either substantially perpendicularly or parallel to the first arm. The planar strip extends substantially perpendicularly from the second arm and is fixedly attached to the second arm between the second tab and the joint for supporting a third structural member. The third tab may extend substantially perpendicularly from the planar strip and may be disposed either substantially parallel to or perpendicular to the second arm. In still another embodiment, the connector has a planar strip with two ends.

Additionally, a trough-shaped guide may be coupled to a groove in a surface of a structural member of the modular doll house, wherein the trough-shaped guide receives and slidably engages the tabs of the connector.

The modular doll house may be purchased as a kit including the structural members having surfaces adapted to receive grooves and the connectors which may have tabs to be placed in the grooves of walls, floors, ceilings, etc. to join the structural members.

Other aspects and advantages of the present invention will become apparent upon consideration of the following drawings and detailed description.

BRIEF DESCRIPTION OF THE DRAWINGS

FIG. 14 is a perspective view of a fourth one of the plurality of connectors associated with the modular doll house of FIG. 1;

FIG. 15 is a fragmentary, exploded, perspective view of two structural members and the connector of FIG. 14 prior to assembly;

FIG. 16 is a fragmentary, exploded, perspective view of two structural members and the connector of FIG. 14 prior to assembly;

DESCRIPTION OF THE PREFERRED EMBODIMENT

Figure 1:
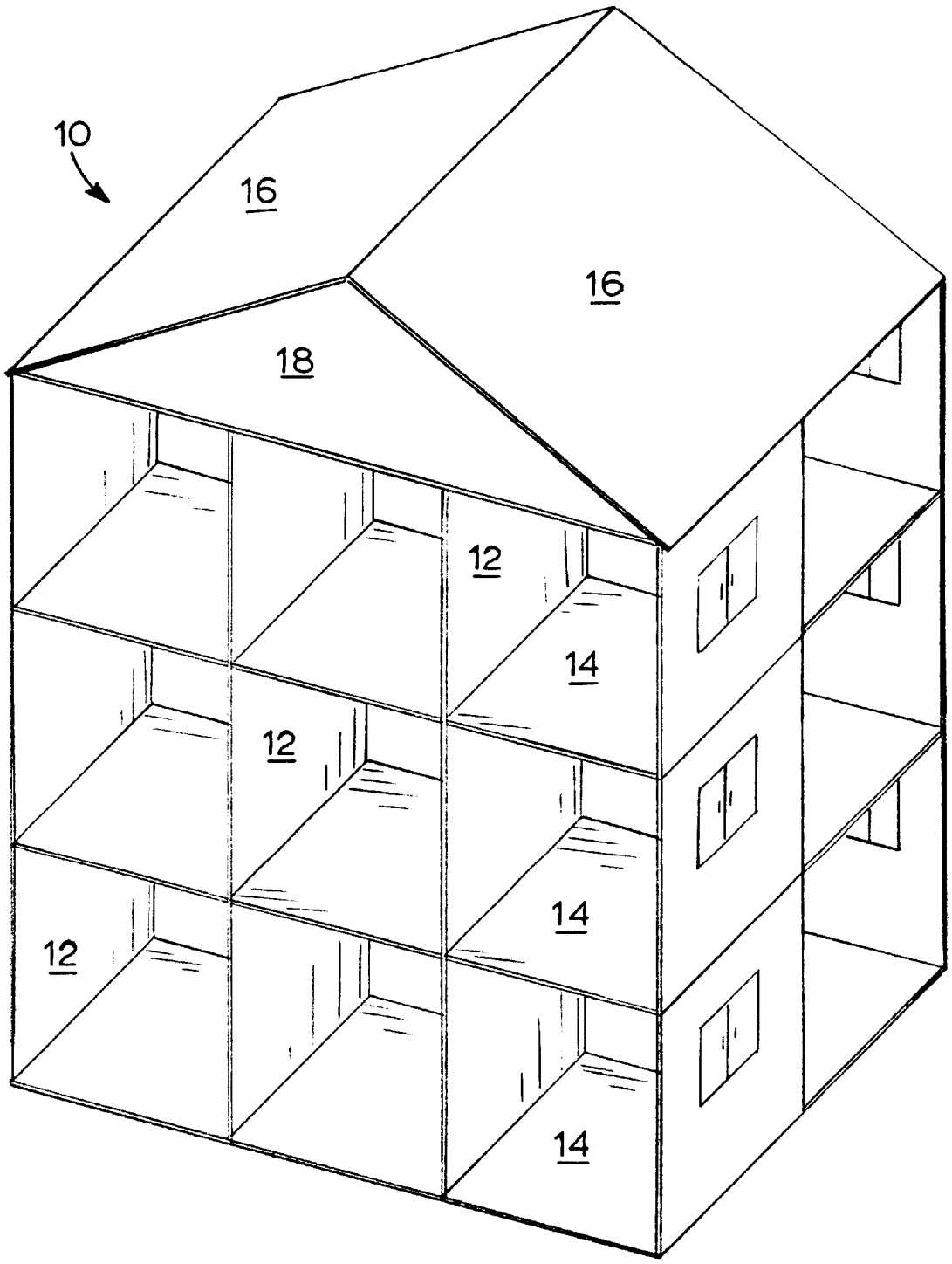
FIG. 1 is a perspective view of a multi-level modular doll house.

Referring first to FIG. 1, a fully assembled modular doll house 10 according to one embodiment of the present invention is illustrated. The modular doll house 10 has a variety of structural members including a plurality of wall members 12, a plurality of floor members 14, a plurality of roof members 16, and a plurality of support members 18. Of course, other structural members may be used as well. A variety of connectors, which are not shown in FIG. 1, are used to hold the structural members 12, 14, 16, 18 of the modular doll house 10 together. The structural members 12, 14, 16, 18 are, preferably, sheet-like panels made of a solid, light-weight, durable, polymer composition that is capable of being easily cut. In a preferred embodiment, the material used to make the structural members 12, 14, 16, 18 is an extruded polystyrene insulation sheet, such as that available commercially from Owens Corning of Toledo, Ohio under the trade name FOAMULAR® insulation. Such insulation sheets are available in varying thicknesses such as ¼ inch (0.635 centimeter), ½ inch (1.27 centimeters) and ¾ inch (1.905 centimeters). These various thicknesses allow the user to construct a modular doll house which is scaled proportionally to the dolls used in connection with the modular doll house. For example, if the user wishes to build a doll house scaled proportionally to Barbie® dolls, the structural members should have a thickness of approximately ½ inch (1.27 centimeters). Additionally, the insulation sheets are available in a variety of colors. A preferred color for the insulation sheet used to make the structural members is pink. Further, the structural members 12, 14, 16, 18 may be sold pre-cut to form a predetermined doll house configuration, or the structural members 12, 14, 16, 18 may be sold as large sheets or panels that may be sectioned or cut into structural members 12, 14, 16, 18 of varying shapes and sizes to accommodate the needs of the user. In other embodiments, the structural members 12, 14, 16, 18 could be made of any other material having similar characteristics including, for example, plastic.

Grooves, which are not shown in FIG. 1, can be cut into the structural members 12, 14, 16, 18 to receive the connectors for interconnecting the structural members 12, 14, 16, 18 of the modular doll house 10. The connectors used with the modular doll house 10 have tabs, not shown in FIG. 1, to slidably engage the grooves cut into the structural members 12, 14, 16, 18. The connectors do not require additional pins or fasteners for connection and, therefore, are simple and easy for children to use. Because the structural members 12, 14, 16, 18 are interconnectable and interchangeable, the structural members 12, 14, 16, 18 can be arranged in many different ways thereby creating a multitude of doll house configurations. Additionally, unlike typical pre-assembled doll houses, rooms of the modular doll house 10 may be arranged to be accessible from the front of the house, either side of the house or the rear of the house. Furthermore, windows, doors, and other structural home accessories such as fireplaces, mantels, staircases, etc. may be attached to or connected to the structural members 12, 14, 16, 18 to customize the modular doll house 10.

Figure 2:
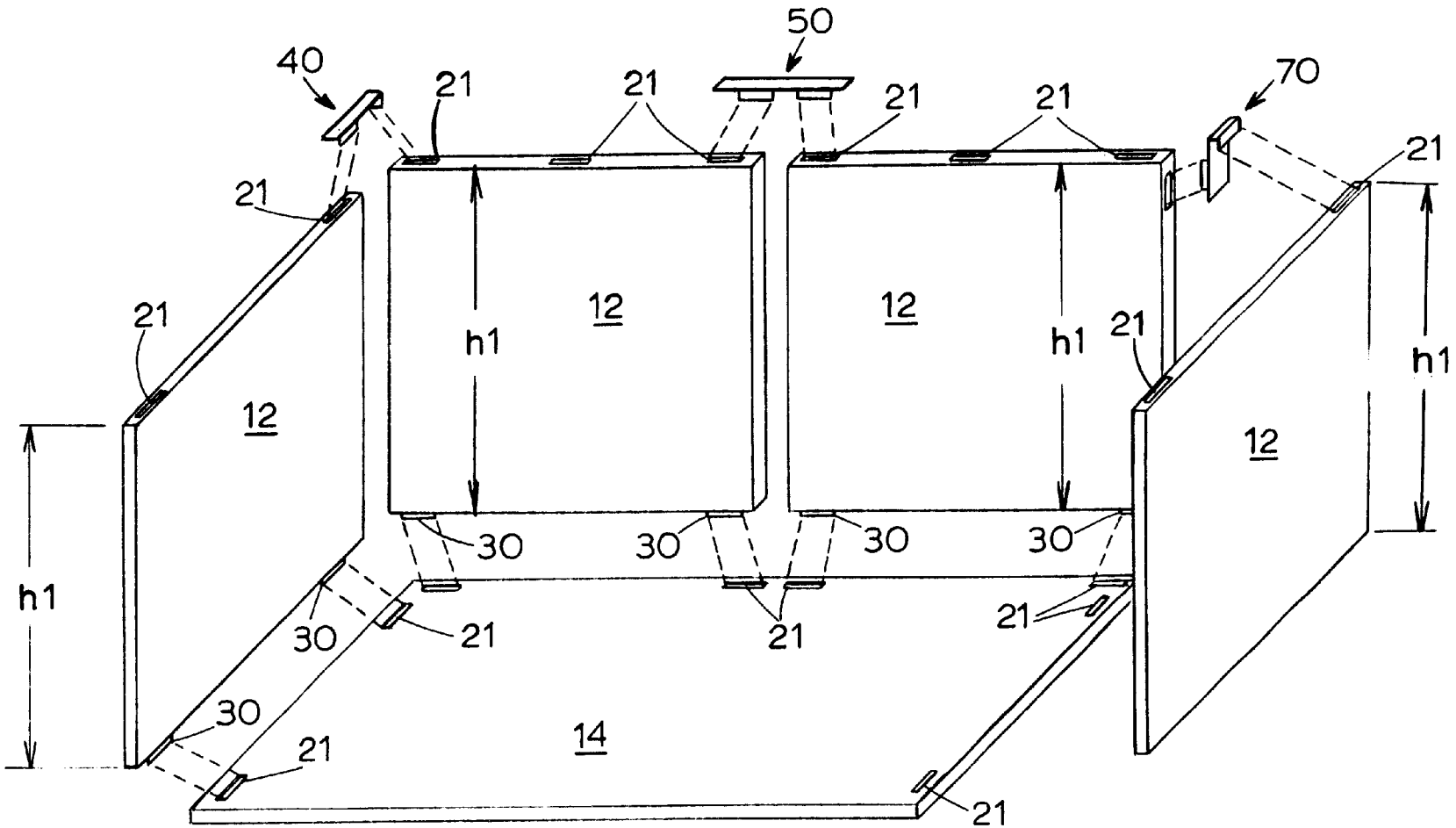
FIG. 2 is an exploded, perspective view of a portion of the modular doll house of FIG. 1 having a plurality of connectors therein.
Figure 3:
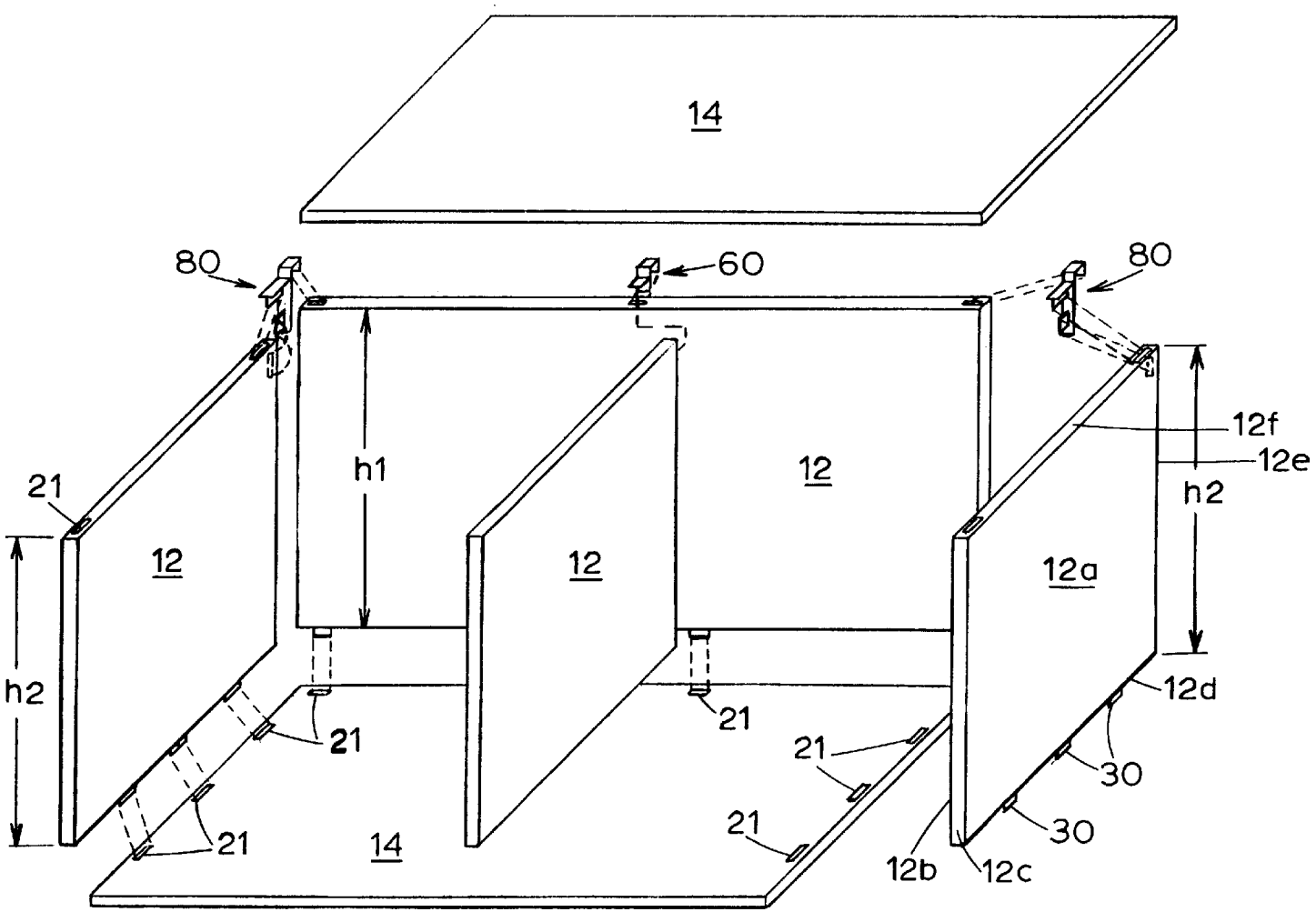
FIG. 3 is an exploded, perspective view of another portion of the modular doll house of FIG. 1 having a plurality of connectors therein.
Figure 4:
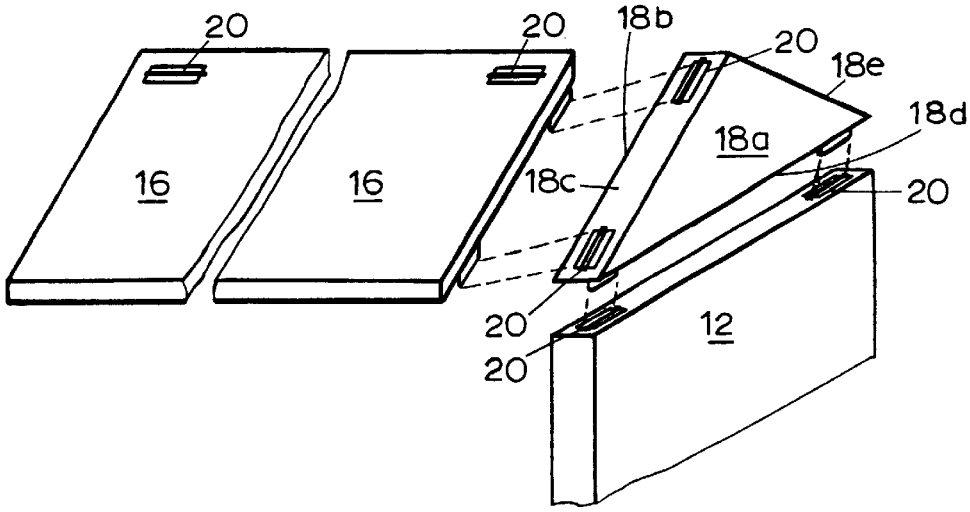
FIG. 4 is a fragmentary, exploded, perspective view of a roof member, a support member, and a wall member of a doll house, illustrated prior to assembly.

FIGS. 2, 3 and 4 depict the structural members 12, 14, 16, 18, a plurality of connectors, a plurality of connector guides 20 and a plurality of grooves 21 before the assembly of the modular doll house 10. As illustrated in FIGS. 2 and 3, most of the structural members 12, 14, 16, 18 are solid parallelepipeds wherein each parallelpiped has six faces. For example, in FIG. 3, one of the plurality of wall members 12 has two broad, substantially flat faces 12*a–b* and four narrow, substantially flat faces 12*c–f*. Each of the wall faces 12*a–f* is capable of having grooves 21 cut into the surface thereof to receive one of the connectors and/or a connector guide 20. Although not illustrated, each of the structural members 12, 14, 16 has two broad faces and four narrow faces. In contrast, the roof support member 18 has a different configuration than the structural members 12, 14, 16. As is best illustrated in FIG. 4, each of the support members 18 has a pyramid-like configuration including five faces 18*a–e*. Each support member 18 has two broad, substantially flat faces 18*a–b* and three narrow, substantially flat faces 18*c–e*, wherein each face is adapted to have grooves 21 cut into its surface to receive one of the connectors and/or a connector guide 20. Although not illustrated, each support member 18 has two broad faces and three narrow faces.

Preferably, the connectors used to construct the modular doll house 10 are made of a light, rigid, durable and sheet-like plastic. However, in an alternate form, the connectors could be made of any material exhibiting similar characteristics. Each of the connectors is, preferably, no greater in width than the depth of the structural members 12, 14, 16, 18 and has round edges to make the doll house safer during assembly or disassembly. Additionally, each of the connectors preferably has first and second tabs, but may have more tabs. Each of a number of connectors and the functions thereof will be more thoroughly described in conjunction with FIGS. 5–25 below.

Figure 5:
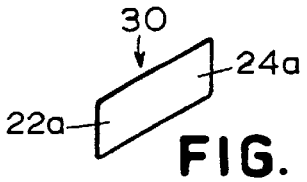
FIG. 5 is a perspective view of one of the plurality of connectors used within the modular doll house of FIG. 1.
Figure 6:
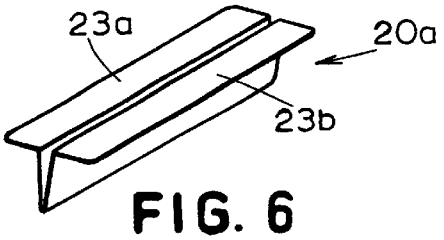
FIG. 6 is a perspective view of a connector guide used with one or more of the plurality of connectors associated with the modular doll house of FIG. 1.
Figure 7:
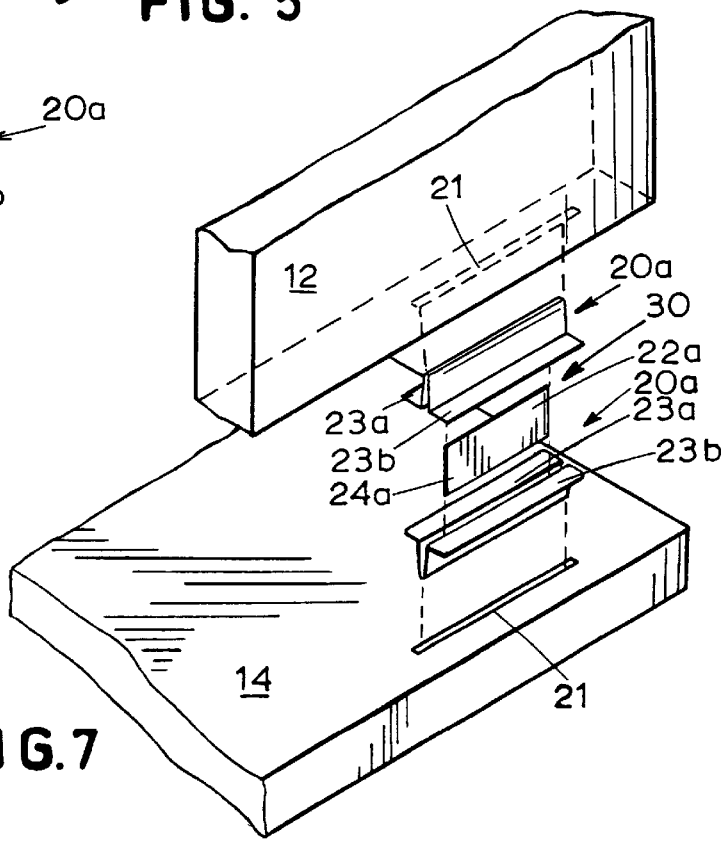
FIG. 7 is a fragmentary, exploded, perspective view of two structural members and the connectors of FIGS. 5 and 6 prior to assembly.

Referring now to FIGS. 4, 5, 6 and 7, a connector 30 and a connector guide 20*a* work in combination to join two structural members 12, 14 of the modular doll house 10. The connector 30, best illustrated in FIG. 5, is a planar strip having two ends forming a first tab 22*a* and a second tab 24*a*. FIG. 6 illustrates the connector guide 20*a* which facilitates the engagement of the connector tabs 22*a*, 24*a* with structural members 12 of the modular doll house 10. As is seen best in FIG. 6, the connector guide 20*a* is trough-shaped and has two substantially flat flaps 23*a*, 23*b* that protect the groove 21 (into which the connector guide 20*a* is placed) from becoming further enlarged or disfigured. Additionally, the flaps 23*a*, 23*b* direct the connector tabs 22, 24, 26 of any connector into the trough-shaped portion of the connector guide 20*a*, thereby creating a secure connection between the connector and the structural member. As illustrated in FIG. 7, each connector guide 20*a* is inserted into one of a plurality of grooves 21 that has been cut into a surface of one of the structural members 12, 14 of the modular doll house 10, wherein the connector guides 20*a* receive and slidably engage the first tab 22*a* and second tab 24*a*. Connector 30 and connector guides 20*a* may join any two structural members 12, 14, 16, 18 together to create a portion of the modular doll house 10.

Figure 8:
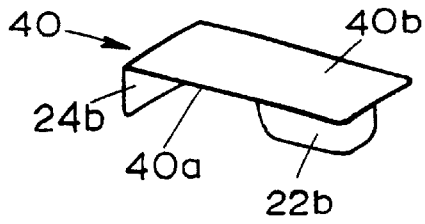
FIG. 8 is a perspective view of a second one of the plurality of connectors associated with the modular doll house of FIG. 1.
Figure 9:
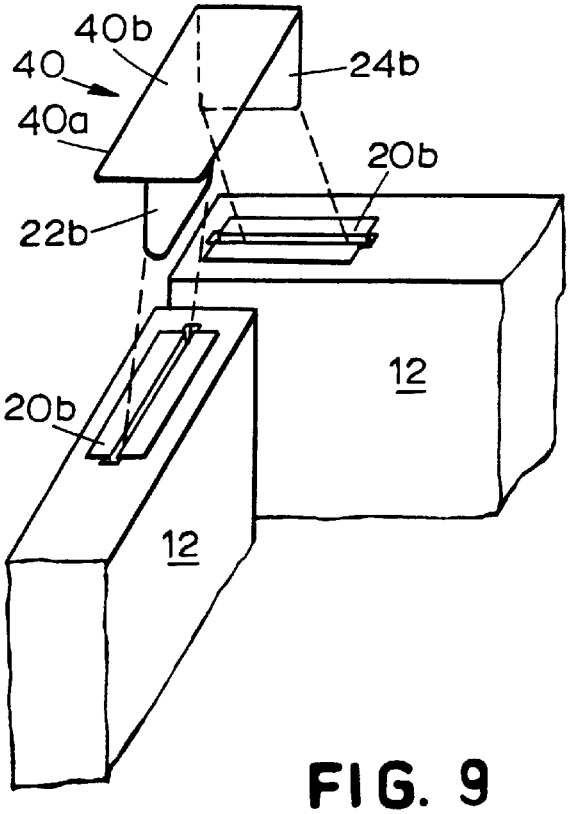
FIG. 9 is a fragmentary, exploded, perspective view of two structural members and the connector of FIG. 8 prior to assembly.
Figure 10:
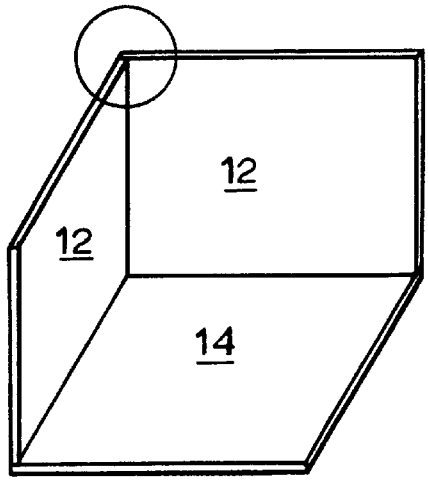
FIG. 10 is a perspective view of the members of FIG. 9 illustrated in assembled form.

Referring to FIGS. 2, 8, 9 and 10, a connector 40 connects two structural members of the modular doll house 10. The connector 40, best illustrated in FIG. 8, is a planar strip having a first flat side 40*a* and a second flat side 40*b*. A first tab 22*b* extends from the first side 40*a* of the planar strip and a second tab 24*b* also extends from the first side 40*a* of the planar strip and is disposed substantially perpendicularly to the first tab 22*b*. As depicted in FIG. 9, the connector 40 slidably engages two wall members 12 by securely fitting each of the tabs 22*b*, 24*b* into corresponding connector guides 20*b* where a single connector guide 20*b* is inserted into the face of each of the structural wall members 12. When the connector 40 is securely in place and, thus, connecting the two structural members 12,.the structural members 12 form one corner of one of the plurality of rooms of the modular doll house 10 as is illustrated in FIG. 10.

Figure 11:
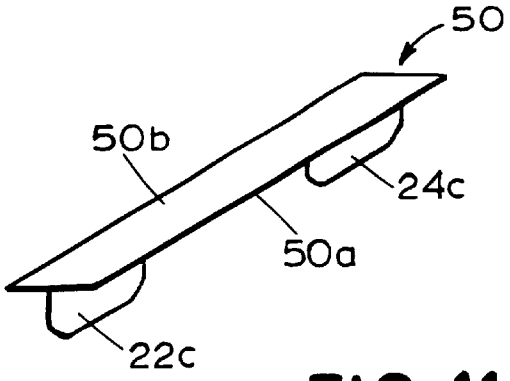
FIG. 11 is a perspective view of a third one of the plurality of connectors associated with the modular doll house of FIG. 1.
Figure 12:
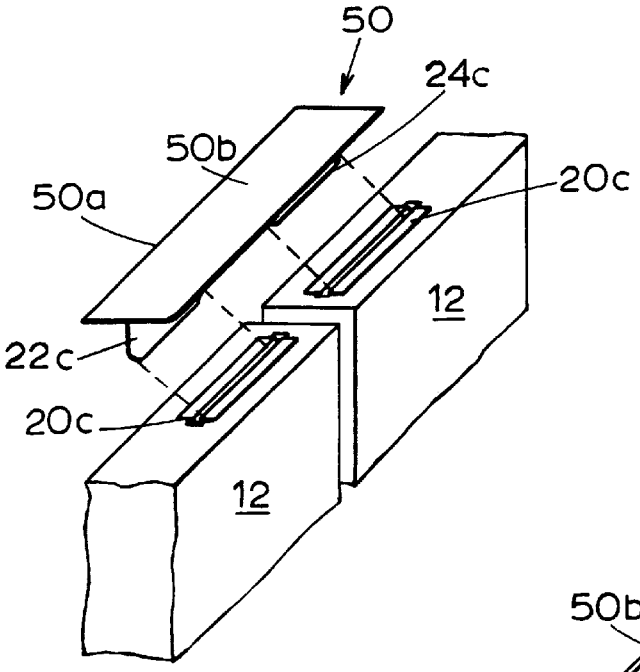
FIG. 12 is a fragmentary, exploded, perspective view of two structural members and the connector of FIG. 11 prior to assembly.
Figure 13:
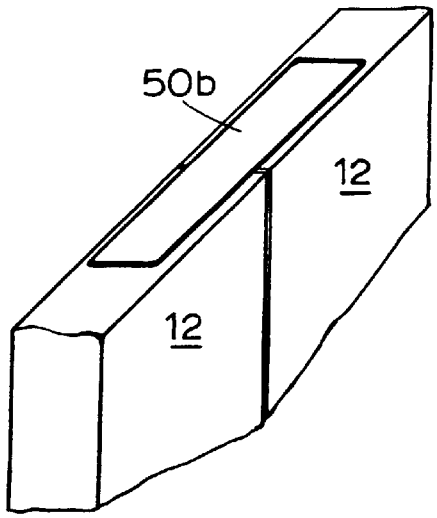
FIG. 13 is a fragmentary, perspective view of the members of FIG. 12 illustrated in assembled form.

FIGS. 2, 11, 12 and 13 illustrate a third type of connector 50 joining two structural members 12 of the modular doll house 10. The connector 50, best illustrated in FIG. 11, is a planar strip having a first flat side 50*a* and second flat side 50*b*. A first tab 22*c* extends from the first side 50*a* of the planar strip and a second tab 24*c* also extends from the first side 50*a* of the planar strip and is disposed substantially parallel to the first tab 22*c*. As depicted in FIG. 12, connector 50 slidably engages two wall members 12 by securely fitting each of the tabs 22*c*, 24*c* into corresponding connector guides 20*c*, wherein a single connector guide 20*c* is inserted into the face of each of the wall members 12. Once the connector 50 engages the wall members 12, the wall members 12 form a secure and durable doll house configuration.

Referring to FIGS. 3, 14, 15 and 16, a connector 60 connects two structural members 12 of the modular doll house 10. The connector 60, best illustrated in FIG. 14, includes an L-shaped strip having a first arm 60*a* and a second arm 60*b*. A first tab 22*d* extends substantially perpendicularly from the first arm 60*a* and is disposed substantially parallel to the second arm 60*b*. A second tab 24*d* extends substantially perpendicularly from the second arm 60*b*, and is disposed substantially parallel to the first arm 60*a*. As depicted in FIG. 15, the connector 60 slidably engages two wall members 12 by securely fitting each of the tabs 22*d*, 24*d* into corresponding connector guides 20*d* where one connector guide 20*d* is inserted into the face of each of the wall members 12. As is depicted in FIG. 16, the connector 60 may also join a wall member 12 and a roof member 16 by slidably engaging the connector guides 20*d* that have been inserted into the face of the wall member 12 and the roof member 16, respectively.

Figure 17:
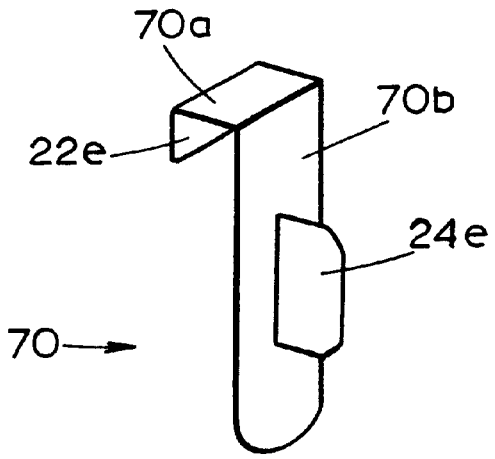
FIG. 17 is a perspective view of a fifth one of the plurality of connectors associated with the modular doll house of FIG. 1.
Figure 18:
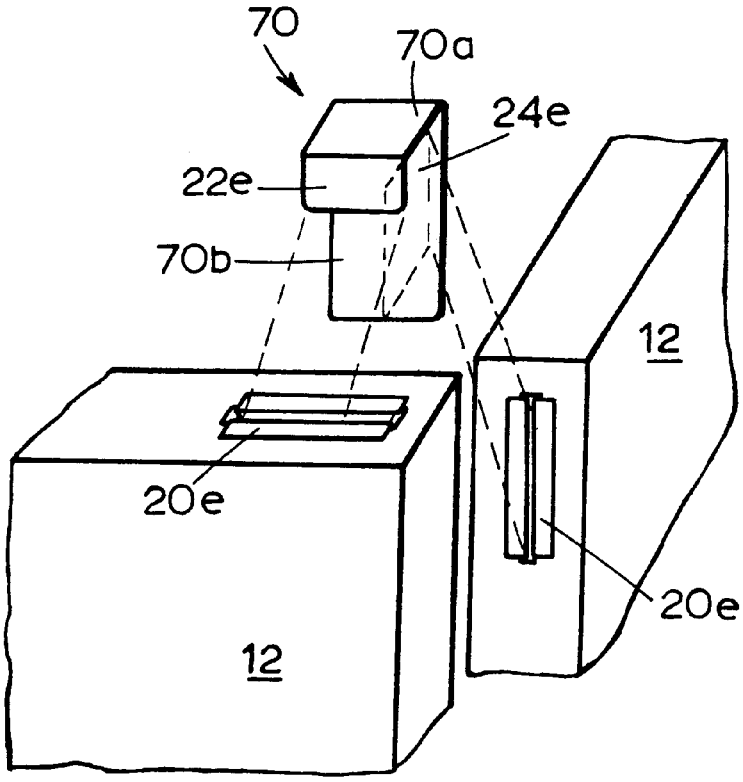
FIG. 18 is a fragmentary, exploded, perspective view of two structural members and the connector of FIG. 17 prior to assembly.
Figure 19:
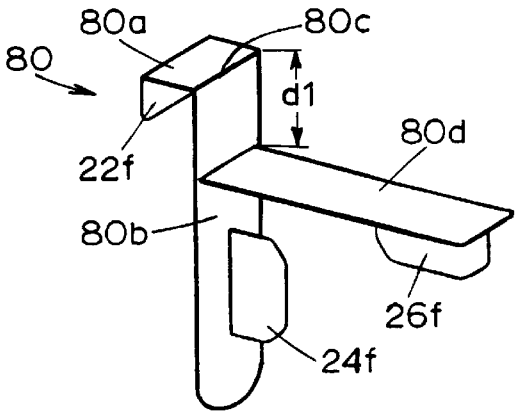
FIG. 19 is a perspective view of a sixth one of the plurality of connectors associated with the modular doll house of FIG. 1.

Referring to FIGS. 2, 17 and 18, a connector 70 connects two structural members 12 of the modular doll house 10. The connector 70, best illustrated in FIG. 17, includes an L-shaped strip having a first arm 70*a* and a second arm 70*b*. A first tab 22*e* extends substantially perpendicularly from the first arm 70*a* and is disposed substantially parallel to the second arm 70*b*. A second tab 24*e* extends substantially perpendicularly from the second arm 70*b*, and is disposed substantially perpendicularly to the first arm 70*a*. As depicted in FIG. 18, connector 70 joins two wall members 12 by slidably and securely engaging each of the tabs 22*e*, 24*e* into corresponding connector guides 20*e* where a single connector guide 20*e* is inserted into the face of each of the wall members 12.

Referring now to FIGS. 3, 19, 20 and 21, a connector 80 joins two structural members 12 and is designed to assist in the support of a third structural member 14 of the modular doll house 10. The connector 80, best illustrated in FIG. 19, includes an L-shaped strip having first arm 80*a* and second arm 80*b*, a joint 80*c* at the connection of the first arm 80*a* and second arm 80*b*, and a planar strip 80*d*. A first tab 22*f* extends substantially perpendicularly from the first arm 80*a* and is disposed substantially parallel to the second arm 80*b* of the L-shaped strip. A second tab 24*f* extends substantially perpendicularly from the second arm 80*b*, and is disposed substantially perpendicularly to the first arm 80*a*. The planar strip 80*d* extends substantially perpendicularly from the second arm 80*b* and is fixedly attached to the second arm 80*b* between the second tab 24*f* and the joint 80*c* for supporting the third structural member 14. A third tab 26*f* extends substantially perpendicularly from the planar strip 80*d*.

Figure 20:
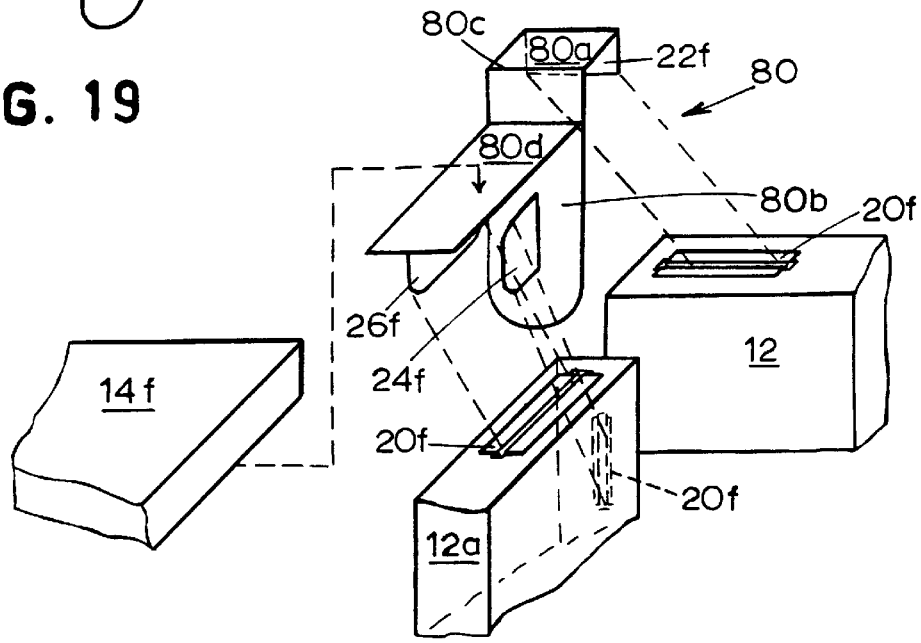
FIG. 20 is a fragmentary, exploded, perspective view of three structural members and the connector of FIG. 19 prior to assembly.
Figure 21:
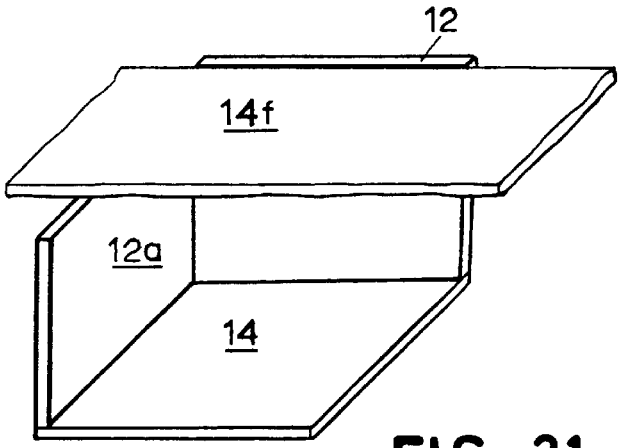
FIG. 21 is a perspective view of the portions of FIG. 20 illustrated in assembled form.

As depicted in FIG. 20, the connector 80 joins two wall members 12, 12*a* by slidably engaging each of the tabs 22*f*, 24*f* and 26*f* with a corresponding connector guide 20*f* that has been inserted into the face of the structural member being joined. Notably, and best illustrated in FIG. 3, the wall member 12*a* engaged by the second tab 24*f* and the third tab 26*f* of connector 80 has a height h2 different from the height h1 of other wall members 12 used to create the modular doll house 10. Height h2 is approximately the height h1 minus a distance d1. In one embodiment, the distance d1 between the joint 80*c* and the planar strip 80*d* is approximately equal to the depth of the floor member 14*f* which rests on top of the planar strip of connector 80. If distance d1 is approximately the depth of the floor member 14*f*, the top face of a floor member 14*f* will be flush with the top face of the wall member 12 slidably engaged with the first tab 22*f* of connector 80 when floor member 14*f* is placed on top of connector 80. Alternatively, the distance d1 between the joint 80*c* and the planar strip 80*d* may be any other desired distance. When the connector 80 is joining the two wall members 12, 12*a* as well as assisting in the support of the floor member 14*f*, the structural members collectively form a corner of one of the plurality of rooms of the modular doll house 10 having a ceiling as is depicted in FIG. 21. Floor members and ceiling members may be used interchangeably.

Figure 22:
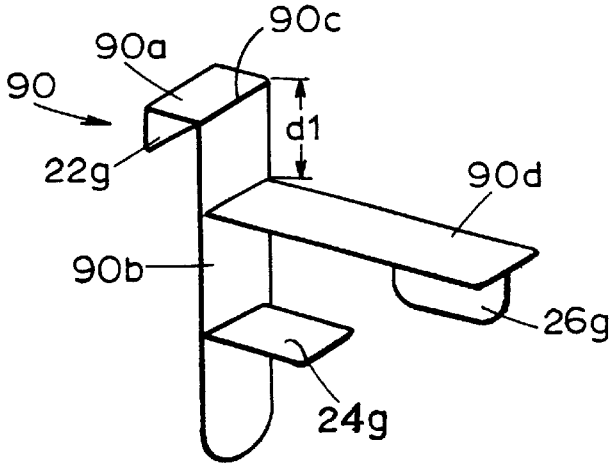
FIG. 22 is a perspective view of a seventh one of the plurality of connectors associated with the modular doll house of FIG. 1.
Figure 23:
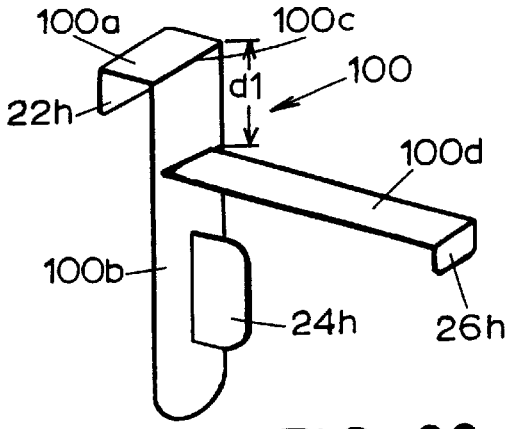
FIG. 23 is a perspective view of an eighth one of the plurality of connectors associated with the modular doll house of FIG. 1.
Figure 24:
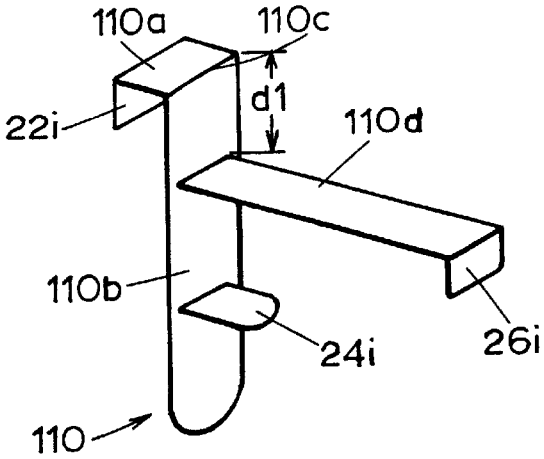
FIG. 24 is a perspective view of a ninth one of the plurality of connectors associated with the modular doll house of FIG. 1.

The connector 90, illustrated in FIG. 22, includes the same structural features as connector 80 except that a second tab 24*g* is positioned differently. The second tab 24*g* is disposed substantially parallel to a first arm 90*a*. Likewise, the connector 100, illustrated in FIG. 23, includes the same structural characteristics as connector 80 except that a third tab 26*h* is positioned differently. The third tab 26*h* is disposed substantially parallel to a second arm 100*b*. Still further, the connector 110, illustrated in FIG. 24, includes the same structural characteristics as connector 80 except that a second tab 24*i* and a third tab 26*i* are positioned differently. In this case, the second tab 24*i* is disposed substantially parallel to a first arm 110*a* and the third tab 26*i* is disposed substantially parallel to a second arm 100*b*. The connectors 90, 100 and 110 are illustrated to show that the connectors may be altered by changing the positioning of the tabs thereon and still operate to connect members together. Of course, the orientation of the grooves may need to be changed in some circumstances.

Figure 25:
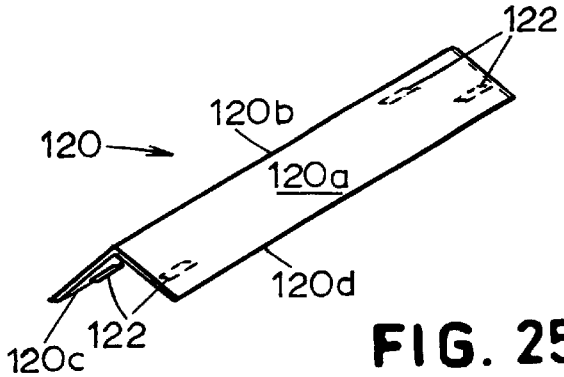
FIG. 25 is a perspective view of a tenth one of the plurality of connectors associated with the modular doll house of FIG. 1.

FIG. 25 illustrates still another connector 120. The connector 120 is an elongated, V-shaped structure having two broad, substantially flat faces 120*a*, 120*b* on the outer surface of the connector 120 and two substantially similar faces 120*c*, 120*d* on the interior of the connector. The interior faces 120*c*, 120*d* include a plurality of tabs 122 that extend from the each face to slidably engage roof members 16 by securely fitting each of the plurality of tabs 122 into a corresponding groove 21 or connector guide 20 that has been inserted into the faces of the roof members 16.

When the tabs 122 of the connector 120 are properly engaged with the structural members of the modular doll house 10, the connector 120 securely joins the roof members and, thus, forms a roof for the modular doll house 10 having a peak.

The modular doll house 10 could be constructed using any other connectors having tabs to slidably engage grooves disposed in the surfaces of the structural members 12,14,16, 18.

Furthermore, the modular doll house 10 can be purchased in a kit including structural members having rigid surfaces and one or more connectors such as those described herein. The structural members of the kit may come as panels that are capable of being cut such that the size of the members may be varied and such that grooves may be formed in the surfaces of the structural members. Alternatively, the structural member may come pre-cut with or without grooves cut therein.

Numerous modifications and alternative embodiments of the invention will be apparent to those skilled in the art in view of the forgoing description. Accordingly, this description is to be construed as illustrative only and the details of the structure may be varied substantially without departing from the spirit of the invention. The exclusive use of all modifications which are within the scope of the appended claims is reserved.

What is claimed is:

1. A modular doll house, comprising:

a first structural member having a first surface and a first groove disposed in the first surface;

a second structural member having a second surface and a second groove disposed in the second surface; and a rigid connector including a first tab adapted to slidably engage the first groove and a second tab adapted to slidably engage the second groove to connect the first structural member to the second structural member, wherein the connector comprises an L-shaped strip having first and second arms, a joint at the connection of the first and second arms, a planar strip and a third tab, and wherein the first tab extends substantially perpendicularly from the first arm and is disposed substantially parallel to the second arm of the L-shaped strip, and wherein the second tab extends substantially perpendicularly from the second arm and is disposed substantially perpendicularly to the first arm, and wherein the planar strip extends substantially perpendicularly from the second arm and is fixedly attached to the second arm between the second tab and the joint for supporting a third structural member, and wherein the third tab extends substantially perpendicularly from the planar strip and is disposed substantially perpendicularly to the second arm.

2. A modular doll house, comprising:

a first structural member having a first surface and a first groove disposed in the first surface;

a second structural member having a second surface and a second groove disposed in the second surface; and a rigid connector including a first tab adapted to slidably engage the first groove and a second tab adapted to slidably engage the second groove to connect the first structural member to the second structural member, wherein a v-shaped guide coupled to the first or second of the grooves in the first or second surfaces of the first and second structural members, wherein the v-shaped guide receives and slidably engages the first or second tab of the connector.

3. A modular doll house kit, comprising:

a plurality of structural members, wherein each structural member has a plurality of rigid surfaces adapted to receive grooves; and a plurality of connectors, wherein each connector has two tabs and wherein each tab is adapted to be placed in one of the grooves of one of the structural members to connect two of the structural members together, wherein the connector comprises an L-shaped strip having first and second arms, a joint at the connection of the first and second arms, a planar strip and a third tab, and wherein the first tab extends substantially perpendicularly from the first arm and is disposed substantially parallel to the second arm of the L-shaped strip, and wherein the second tab extends substantially perpendicularly from the second arm and is disposed substantially perpendicularly to the first arm, and wherein the planar strip extends substantially perpendicularly from the second arm and is fixedly attached to the second arm between the second tab and the joint for supporting a third structural member, and wherein the third tab extends substantially perpendicularly from the planar strip and is disposed substantially perpendicularly to the second arm.

4. A modular doll house kit, comprising:

a plurality of structural members, wherein each structural member has a plurality of rigid surfaces adapted to receive grooves; and a plurality of connectors, wherein each connector has two tabs and wherein each tab is adapted to be placed in one of the grooves of one of the structural members to connect two of the structural members together, further comprising a v-shaped guide coupled to a first groove in a first surface of a first structural member or a second groove of a second surface of a second structural member wherein the v-shaped guide receives and slidably engages a first tab or a second tab of the connector.

5. A modular doll house, comprising:

a floor member wherein the floor member includes a rigid surface and a groove disposed in the rigid surface;

a plurality of wall members wherein each of the plurality of wall members includes a rigid surface and a groove disposed in the rigid surface; and a plurality of connector members wherein each connector member includes a first tab adapted to slidably engage one of the grooves of the floor or wall members and a second tab adapted to slidably engage a different one of the grooves of the floor or wall members to connect the floor or wall members together, wherein the connector comprises an L-shaped strip having first and second arms, a joint at the connection of the first and second arms, a planar strip and a third tab, and wherein the first tab extends substantially perpendicularly from the first arm and is disposed substantially parallel to the second arm of the L-shaped strip, and wherein the second tab extends substantially perpendicularly from the second arm and is disposed substantially perpendicularly to the first arm, and wherein the planar strip extends substantially perpendicularly from the second arm and is fixedly attached to the second arm between the second tab and the joint for supporting a third structural member, and wherein the third tab extends substantially perpendicularly from the planar strip and is disposed substantially perpendicularly to the second arm.

6. A modular doll house, comprising:

a floor member wherein the floor member includes a rigid surface and a groove disposed in the rigid surface;

a plurality of wall members wherein each of the plurality of wall members includes a rigid surface and a groove disposed in the rigid surface; and a plurality of connector members wherein each connector member includes a first tab adapted to slidably engage one of the grooves of the floor or wall members and a second tab adapted to slidably engage a different one of the grooves of the floor or wall members to connect the floor or wall members together, further comprising a v-shaped guide coupled to the groove disposed in the rigid surface of the floor or wall members wherein the v-shaped guide receives and slidably engages the first or second tab of the connector.

* * * * *